US009945004B2

(12) United States Patent
Park et al.

(10) Patent No.: US 9,945,004 B2
(45) Date of Patent: Apr. 17, 2018

(54) MATERIAL FOR HIGH CARBURIZING STEEL AND METHOD FOR PRODUCING A GEAR USING THE SAME

(71) Applicants: Hyundai Motor Company, Seoul (KR); SeAH Besteel Corporation, Seoul (KR)

(72) Inventors: Jae Hong Park, Seoul (KR); Jung Ho Shin, Jeollabuk-do (KR); Woon Jae Lee, Jeollabuk-do (KR)

(73) Assignees: Hyundai Motor Company, Seoul (KR); SeAH Besteel Corporation, Seoul (KR)

( * ) Notice: Subject to any disclaimer, the term of this patent is extended or adjusted under 35 U.S.C. 154(b) by 489 days.

(21) Appl. No.: 14/535,255

(22) Filed: Nov. 6, 2014

(65) Prior Publication Data

US 2015/0176100 A1 Jun. 25, 2015

(30) Foreign Application Priority Data

Dec. 24, 2013 (KR) ..... 10-2013-0162626

(51) Int. Cl.

| | |
|---|---|
| ***C21D 9/32*** | (2006.01) |
| ***C21D 1/06*** | (2006.01) |
| ***C22C 38/28*** | (2006.01) |
| ***C22C 38/26*** | (2006.01) |
| ***C22C 38/24*** | (2006.01) |
| ***C22C 38/22*** | (2006.01) |
| ***C22C 38/20*** | (2006.01) |
| ***C22C 38/04*** | (2006.01) |
| ***C22C 38/00*** | (2006.01) |
| ***C22C 38/02*** | (2006.01) |
| ***C21D 6/02*** | (2006.01) |
| ***C21D 6/00*** | (2006.01) |
| ***C23C 8/22*** | (2006.01) |

(52) U.S. Cl.

CPC ..... *C21D 9/32* (2013.01); *C21D 1/06* (2013.01); *C21D 6/002* (2013.01); *C21D 6/005* (2013.01); *C21D 6/008* (2013.01); *C21D 6/02* (2013.01); *C22C 38/002* (2013.01); *C22C 38/02* (2013.01); *C22C 38/04* (2013.01); *C22C 38/20* (2013.01); *C22C 38/22* (2013.01); *C22C 38/24* (2013.01); *C22C 38/26* (2013.01); *C22C 38/28* (2013.01); *C23C 8/22* (2013.01)

(58) Field of Classification Search

CPC .... C23C 8/22; C23C 8/32; C21D 9/32; C21D 1/06; C21D 6/02

See application file for complete search history.

(56) References Cited

FOREIGN PATENT DOCUMENTS

| | | | |
|---|---|---|---|
| JP | H05-093244 | A | 4/1993 |
| JP | 2007-284739 | A | 11/2007 |
| JP | 2009-114484 | A | 5/2009 |
| JP | 2009-299148 | A | 12/2009 |
| JP | 4927234 | B2 | 5/2012 |
| JP | 2012-224928 | A | 11/2012 |
| KR | 10-2002-0085366 | | 11/2002 |
| KR | 10-2007-0095390 | | 9/2007 |
| KR | 10-0854569 | | 8/2008 |

*Primary Examiner* — Jessee Roe

(74) *Attorney, Agent, or Firm* — Mintz Levin Cohn Ferris Glovsky and Popeo, P.C.; Peter F. Corless

(57) ABSTRACT

A material for high carburizing steel and a method for producing a gear using the material are provided. The material includes C of about 0.13 to 0.3 wt %, Si 0.7 to 1.3 wt %, Mn of about 0.3 to 1 wt %, P of about 0.02 wt % or less, S of about 0.03 wt % or less, Cr of about 2.2 to 3.0 wt %, Mo of about 0.2 to 0.7 wt %, Cu of about 0.3 wt % or less, Nb of about 0.03 to 0.06 wt %, V of about 0.1 to 0.3 wt %, Ti of about 0.001 to 0.003 wt %, a balance of Fe and other inevitable.

7 Claims, 1 Drawing Sheet

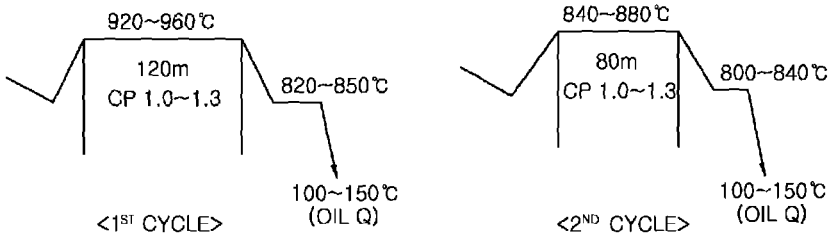
920~960℃
120m
CP 1.0~1.3
820~850℃
100~150℃
(OIL Q)
<1ST CYCLE>
840~880℃
80m
CP 1.0~1.3
800~840℃
100~150℃
(OIL Q)
<2ND CYCLE>

MATERIAL FOR HIGH CARBURIZING STEEL AND METHOD FOR PRODUCING A GEAR USING THE SAME

CROSS-REFERENCE TO RELATED APPLICATION

This application claims under 35 U.S.C. § 119(a) the benefit of Korean Patent Application No. 10-2013-0162626 filed on Dec. 24, 2013, the entire contents of which are incorporated herein by reference.

TECHNICAL FIELD

The present invention relates to a material for high carburizing steel, which is optimized to a gear, and a method for producing a gear using the same.

BACKGROUND

Generally, contact stress is generated as gears are interlocked, and thereby generating fitting and the like on the surface of a gear part. Accordingly, durability of the gear parts may be reduced and noise may occur. Particularly, when load applied to a gear is increased with such a gear which is downsized or minimized and a powertrain has high output, the above-mentioned problems get serious. Due to these durability problems, there have been attempts to improve durability, for example, providing steels with improved fitting resistance, performing a carbonitriding treatment or adding a shot-peening process. However, heavily loaded gears also may cause problems during endurance test.

For example, when the carbonitriding treatment is employed, fitting resistance characteristic can be improved but bending strength is reduced. Moreover, when the shot-peening process is added to the manufacturing process, bending strength can be improved, but fitting resistance characteristic is reduced. Although a high carburizing method is an innovative method in the art by improving the fitting resistance characteristic and the bending strength at the same time, the conventionally performed high carburizing method may not be applied to manufacturing of gears because of deep hardening-depth, brittleness due to formation of carbide in the form of network/coarse, and severe thermal degradation during heat treatment.

Recently, a transmission gear has been produced using steel material having improved fitting resistance or by modified carbonitriding heating method. This steel grade has elevated high-temperature softening resistance due to high contents of silicon (Si) and molybdenum (Mo), and quenching property thereof is improved by increased chromium (Cr) content. In some cases, the modified carbonitriding method has been used for increasing the fitting resistance by increasing the amount of residual austenite and has been used for manufacturing a gear. The conventional high carburizing method has been employed for increasing wear resistance by forming carbide on the surface. However, it is difficult to apply to a gear due to large carbide size and deep hardening-depth. Further, gear tooth may be deformed significantly to cause noise and durability problems when such high carburizing method is applied.

The description provided above as a related art of the present invention is just for helping understanding the background of the present invention and should not be construed as being included in the related art known by those skilled in the art.

SUMMARY

The present invention provides a material for high carburizing steel, which is optimized to a gear, and a method for producing a gear using the same.

In one exemplary embodiment according to the present invention, the material for high carburizing steel may comprise: carbon (C) of about 0.13 to 0.3 wt %, silicon (Si) of about 0.7 to 1.3 wt %, manganese (Mn) of about 0.3 to 1 wt %, phosphorus (P) of about 0.02 wt % or less, sulfur (S) of about 0.03 wt % or less, chromium (Cr) of about 2.2 to 3.0 wt %, molybdenum (Mo) of about 0.2 to 0.7 wt %, copper (Cu) of about 0.3 wt % or less, niobium (Nb) of about 0.03 to 0.06 wt %, vanadium (V) of about 0.1 to 0.3 wt %, titanium (Ti) of about 0.001 to 0.003 wt %, a balance of iron (Fe) and other inevitable impurities.

The method for producing a gear using the same high carburizing steel material comprising above composition may include: manufacturing a gear shape using the high carburizing steel material above; heating the manufactured gear shape at the condition of temperature of about 900° C. or greater and carbon potential (CP) of about 1.0 or greater for dissolving carbon; compulsively cooling the gear shape; quenching the gear shape; heating the gear shape at the condition of temperature of about 800° C. or greater and CP of about1.0 or greater for dissolving carbon; compulsively cooling the gear shape; and quenching the gear shape.

In the first carbon solid-dissolving step, the gear shape may be dissolved at the condition of temperature of about 920 to 960° C. or higher and CP of about 1.0 to 1.3 . In the first cooling step, the gear shape may be compulsively cooled for about 5 to 15 min to temperature of about 820 to 850° C. The first quenching step may be conducted at temperature of about 100 to 150° C. in oil. In the second solid-dissolving step, the gear shape may be heated at the condition of temperature of about 840 to 880° C. or greater and CP of about 1.0 to 1.3 for dissolving carbon. In the second cooling step, the gear shape may be compulsively cooled for about 5 to 15 min to temperature of about 800 to 840° C. The second quenching step may be conducted at temperature of about 100 to 150° C. in oil.

BRIEF DESCRIPTION OF THE DRAWINGS

The above and other features of the present invention will now be described in detail with reference to exemplary embodiments thereof illustrated the accompanying drawings which are given hereinbelow by way of illustration only, and thus are not limitative of the present invention, and wherein:

FIG. 1 is an exemplary diagram illustrating a heating process of the method for producing a gear using the material for high carburizing steel according to one exemplary embodiment of the present invention.

It should be understood that the accompanying drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Hereinafter, the exemplary embodiments of the present invention now will be described in detail with reference to the accompanying drawings.

The material for high carburizing steel according to one exemplary embodiment of the present invention may include: C of about 0.13 to 0.3 wt %, Si of about 0.7 to 1.3 wt %, Mn of about 0.3 to 1 wt %, P of about 0.02 wt % or less, S of about 0.03 wt % or less, Cr of about 2.2 to 3 wt %, Mo of about 0.2 to 0.7 wt %, Cu of about 0.3 wt % or less, Nb of about 0.03 to 0.06 wt %, V of about 0.1 to 0.3 wt %, Ti of about 0.001 to 0.003 wt %, a balance of Fe and other inevitable impurities.

In another exemplary emboidment of the present invention, the method for producing a gear using the same high carburizing steel material comprising above composition may include: manufacturing gear shape having the composition of the high carburizing steel material discussed above; heating the manufactured gear shape at the condition of temperature of about 900° C. or greater and CP of about 1.0 or greater for dissolving carbon; compulsively cooling the gear shape; quenching the gear shape; heating the gear shape at the condition of temperature of about 800° C. or greater and CP of about 1.0 or greater for dissolving carbon; compulsively cooling the gear shape; and a second quenching step of quenching the gear shape.

In particular, in the first carbon solid-dissolving step, the gear shape may be dissolved at the condition of temperature of about 920 to 960° C. or greater and CP of about 1.0 to 1.3. In the first cooling step, the gear shape may be compulsively cooled for about 5 to 15 min to temperature of about 820 to 850° C. The first quenching step may be conducted at temperature of about 100 to 150° C. in oil. In addition, in the second solid-dissolving step, the gear shape may be heated at the condition of temperature of about 840 to 880° C. or greater and CP of about 1.0 to 1.3 for dissolving carbon. In the second cooling step, the gear shape may be compulsively cooled for about 5 to 15 min to temperature of about 800 to 840° C. The second quenching step may be conducted at temperature of about 100 to 150° C. in oil.

In another exemplary embodiment, the present invention relates to a material for high carburizing steel and a method for producing a gear using the high carburizing heat treatment. In particular, in the method for producing a gear, a bar steel may be hot forged (e.g., die forged), and the forged product may be cooled, normalized or annealed. When the forged product is normalized and annealed, structure homogenization effect may be obtained by maintaining the forged product at the temperature of AC3 or greater followed by air cooling or furnace cooling. Accordingly, hardness may be about HV 150 to 250. Heat-treatment may be selectively performed according to the strength required to parts, and further aims to structure homogenization, strength increase and workability enhancement.

The heat-treated parts may be shaped to fit gear shape by polishing, and then gear teeth processing may be conducted to produce the gear shape. In conventional methods, carburizing heat treatment is conducted to the gear shape, and occasionally carbonitriding treatment is conducted for parts requiring fitting resistance. In contrast, the present invention provides the method to improve durability by high carburizing treatment without additional carbonitriding treatment as in such conventional methods.

The material of the present invention may have the following composition according to one exemplary embodiment.

TABLE 1

| | Steel for Improving Fitting Resistance | | | | | | | | | | |
|---|---|---|---|---|---|---|---|---|---|---|---|
| | C | Si | Mn | P | S | Cr | Mo | Cu | Nb | V | Ti |
| Results | 0.13~0.30 | 0.7~1.3 | 0.3~1.0 | 0.020 or less | 0.030 or less | 2.2~3.0 | 0.2~0.7 | 0.30 or less | 0.03~0.06 | 0.1~0.3 | 0.001~0.003 |

(1) Carbon (C)

Carbon (C) increases strength and hardness of a material, and may be added as an essential element for precipitating carbide from fine alloys. When the amount of carbon is 0.13 wt % or less, tensile strength may decrease, and when the amount of carbon is 0.30 wt % or greater, impact toughness may decrease. Accordingly, the content of carbon may be about 0.13 to 0.30 wt %.

(2) Silicon (Si)

Silicon (Si) increases hardness, elastic modulus and the like, and is a factor for strengthening ferrite phase. Further, silicon plays a role to maintain hardness during endurance test by improving high temperature softening resistance. In addition, silicon is spheroidized the carbide during high carburizing, and has an effect of preventing grain-boundary precipitation. Accordingly, silicon may be used in an amount of about 0.7 wt % or greater. However, when the silicon content is excessive (e.g., above a predetermined threshold), silicon may cause deterioration in elongation and impact property. Therefore, the content of silicon may be about 0.7 to 1.3 wt %.

(3) Manganese (Mn)

Manganese (Mn) may be added in an amount of about 0.3 wt % or greater for reinforcing quenching property and strength. However, when the Mn content is excessive (e.g., above a predetermined threshold), workability may decrease. Accordingly, the content of manganese may be about 0.3 to 1.00 wt %.

(4) Phosphorus (P)

Phosphorus (P) may form an iron phosphide ($Fe_3P$) compound, and this compound is brittle and segregated. Therefore, it may not be homogenized by annealing, and may be longitudinally stretched during forging and rolling. Accordingly, the content of phosphorus may be about 0.020 wt % or less since the iron phosphide reduces impact resistance and stimulates tempering brittleness.

(5) Sulfur (S)

Sulfur is a non-metallic inclusion in a general alloy steel. Sulfur may be combined with Mn to form manganese sulfide (MnS) which may improve machinability. However, when the S content increases, strength may deteriorate. Accordingly, the content of sulfur may be about 0.030 wt % or less.

(11) Titanium (Ti)

Titanium has excellent carbide forming ability, forms fine carbide, and refines steel structure. Accordingly, it may be used in an amount of 0.001 wt % or greater. Meanwhile, due to high cost of Ti, the content of titanium may be about 0.001 to 0.003 wt %.

More specific comparative test data with the conventional steel material compositions are presented below. In order to conduct high carburizing heat treatment, it is necessary to add alloy elements which are advantageous to form carbide. Chemical elements required for the composition in the present invention may be Si, Cr, V, Ti and Mo, and a test controlling carbide was conducted by optimization.

TABLE 2

| | | Major alloy ingredient (wt %) | | | | | | | | Physical property test | | | | |
|---|---|---|---|---|---|---|---|---|---|---|---|---|---|---|
| | Object | C | Si | Mn | Cr | Mo | V | Ti | Nb | Jominy (J5/J11) | Network carbide | Coarse carbide | Contact Stress Life (3.2 GPa) | Contact Stress Life (3.5 GPa) |
| #1 | Conventional Material | 0.2 | 0.6 | 0.6 | 2.0 | 0.35 | — | — | 0.035 | 45.7/ 41.5 | ○ | ○ | 5,620,000 | 1,180,000 |
| #2 | More Si, Cr Remove Mo | 0.2 | 1.0 | 0.6 | 2.5 | — | — | — | 0.035 | 44.9/ 38.2 | X | ○ | 6,120,000 | 2,180,000 |
| #3 | Add Mo compared to #2 | 0.2 | 1.0 | 0.6 | 2.5 | 0.2 | — | — | 0.035 | 45.2/ 37.8 | X | ○ | 7,090,000 | 3,020,000 |
| #4 | Add V, Ti compared to #2 | 0.2 | 1.0 | 0.6 | 2.5 | — | 0.1 | 0.001 | 0.035 | 44.1/ 37.5 | X | X | 10,000,000 Not damaged | 6,700,000 |
| #5 | More Cr than #2 | 0.2 | 1.0 | 0.6 | 2.8 | — | — | — | 0.035 | 44.7/ 39.2 | X | X | 10,000,000 Not damaged | 5,750,000 |

(6) Chromium (Cr)

Chromium (Cr) is an essential element for precipitating carbide, and therefore, it may be used in an amount of 2.2 wt % or greater. However, when the content of chromium is excessive (e.g., above a predetermined threshold), coarse carbide may be formed. Accordingly, the content of chromium may be about 2.2 to 3.0 wt %.

(7) Molybdenum (Mo)

Mo enhances hardness and prevents tempering brittleness. Further, it is an essential element for forming carbide, and makes the carbide be more evenly distributed. Accordingly, the content of molybdenum may be used in an amount of 0.2 wt % or greater. However, due to high cost of Mo, the content of molybdenum may be about 0.2 to 0.7 wt %.

(8) Copper (Cu)

When Cu is used in an amount of 0.3 wt % or greater, deterioration may occur in hot workability and red brittleness. Accordingly, the content of copper may be about 0.3 wt % or less.

(9) Niobium (Nb)

Niobium is an element for strong grain refining. Accordingly, niobium may increase grain coarsening temperature and refine carbide. Meanwhile, due to high cost of Nb, the content of niobium may be about 0.03 to 0.06 wt %.

(10) Vanadium (V)

Vanadium has high carbide forming ability. Accordingly, vanadium may form fine carbide and refine steel structure, and also has improved tempering softening resistance. However, vanadium oxide ($V_2O_5$) may evaporate at high temperatures (e.g., above a predetermined temperature) due to the high vapor pressure. Accordingly, the content of vanadium may be about 0.1 to 0.3 wt %.

From the test results in Table 2, the amount of carbide was increased and formation of network carbide was inhibited by increasing the contents of Si and Cr, and formation of coarse carbide was inhibited by increasing contents of V and Ti, thereby forming finely dispersed carbide.

In order to apply the high carburizing heating method of the present invention to a gear, the following conditions are essential.

1. Carbide shape, Size control
2. Hardening-depth optimization
3 Minimizing occurrence of thermal degradation However, when applying the conventional high carburizing method to a gear, it may be impossible due to the following problems.

1. Carbide shape, Size: Partial existing of network carbide, Average size 10 μm
2. Hardening-depth: 1.0-1.5 mm
3. Degree of thermal degradation occurrence: Lead angle error margin 40 μm In one exemplary embodiment of the high carburizing heating method in the present invention, the conditions illustrated in FIG. 1 may be applied to production of a gear. A first cycle ($1^{ST}$ cycle as shown in FIG. 1) is a process to form a structure when carbon is super-saturated. The first cycle may include a first solid-dissolving step; a first cooling step; and a first quenching step.

In the first solid-dissolving step, a gear shape may be heated at austenitizing temperature of about 920° C. or greater for fully dissolving carbon, and the temperature is limited below 960° C. because crystalline may grow when heated over 960° C. Therefore, the temperature of the first solid-dissolving step may be about 920 to 960° C. CP (Carbon Potential) is controlled at 1.0 or greater for carbide precipitation, and is limited because carbide may be formed when it is 1.3 or greater. Therefore, CP in the first solid-dissolving step is preferably between 1.0 and 1.3.

In the first cooling step, the gear shape may be compulsively cooled to the temperature of about 820 to 850° C. before quenching for minimizing thermal degradation. This step may be maintained within about 10 min but as short as possible for preventing excessive precipitation of carbide. In the first quenching step, oil temperature is controlled to 100° C. or greater to minimize thermal degradation, and is limited to 150° C. or less for forming uniform martensite. Therefore, the first quenching step may be conducted at 100 to 150° C. in oil.

A second cycle ($2^{ND}$ cycle as shown in FIG. 1) is a process to precipitate carbide, and the second cycle may include a second solid-dissolving step; a second cooling step; and a second quenching step.

In the second solid-dissolving step, the gear shape is heated to the temperature of about 840 to 880° C., which is just above ACM curve. When heating below 840° C., coarse carbide is precipitated, and when heating over 880° C., the amount of carbide precipitated is reduced. Therefore, the temperature of the second solid-dissolving step may be about 840 to 880° C. CP may be maintained at the same level with the first solid-dissolving step for forming high carburizing condition.

In the second cooling step, the gear shape may be compulsively cooled to the temperature of about 800 to 840° C. before quenching to minimize thermal degradation. This step may be maintained less than 10 min as short as possible for preventing excessive precipitation of carbide. In the second quenching step, oil temperature may be controlled to 100° C. or greater, and limited to 150° C. or less. Therefore, the second quenching step may be maintained at the same level with the first quenching step.

The comparative tests results below in Table 3 are obtained by applying the high carburizing heating method of the present invention using the Conventional Material in Table 2 and the composition of the present invention in Table 1.

TABLE 3

| | Physical property test | | | | |
|---|---|---|---|---|---|
| | Network carbide | Coarse carbide | Average carbide size | Contact stress life (3.2 GPa) | Contact stress life (3.5 GPa) |
| Conventional Material + high carburizing method of the present invention | x | x | 5-8 μm | 10,000,000 Not damaged | 3,460,000 |
| Material of the present invention + high carburizing method of the present invention | x | x | 2 μm or less | 10,000,000 Not damaged | 10,000,000 Not damaged |

When applying the high carburizing method of the present invention to the Conventional Material in Table 2, the network and coarse carbide are improved, but average carbide size was of about 5 to 8 μm, which is considered as substantially large carbide size. To the contrast, when applying the high carburizing method to the material of the present invention, the size of average carbide size was of about 1 to 2 μm. Since fine carbide has resistance to crack and large carbide tends to progress crack. Accordingly, the present invention provides an advantageous effect by finely controlling carbide. A real gear was produced by using the composition for high carburizing steel material and by the heating method for high carburizing of the present invention, and then the shape and size of carbide, tooth shape, and the like of the produced gear were measured. Therefore, as another advantageous effects of the present invention, innovative improvements were obtained in three essential factors of a gear, and further it was possible to apply super-carburization to a gear.

1. Carbide shape, Size control: Previous 10 μm→2 μm or less

2. Hardening-depth optimization: Previous 1~1.5 mm→0.6~1.0 mm

3. Minimizing occurrence of thermal degradation: Previous lead angle error margin 40 μm→20 μm According to the material for high carburizing steel comprising the composition above and a method for producing a gear using the same, innovative improvements could be obtained in essential factors of a gear, such as carbide shape and size/hardening-depth/thermal degradation, compared with the conventional steel material and heating method, further it may be possible to apply super-carburization to a gear.

The invention has been described in detail with reference to preferred embodiments thereof. However, it will be appreciated by those skilled in the art that changes or modifications may be made in these embodiments without departing from the principles and spirit of the invention, the scope of which is defined in the appended claims and their equivalents.

What is claimed is:

1. A method for producing a gear using a steel material comprises:

manufacturing gear shape using the steel material;

heating the manufactured gear shape at the condition of temperature of about 900 ° C. or greater and carbon potential (CP) 1.0 or greater for dissolving carbon;

cooling the gear shape;

quenching the gear shape;

heating the gear shape at the condition of temperature of about 800° C. or greater and CP 1.0or greater for dissolving carbon;

cooling the gear shape; and quenching the gear shape, wherein the steel material comprises carbon of about 0.13 to 0.30 wt%, silicon of about 0.7 to 1.3 wt%, manganese of about 0.3 to 1 wt%, phosphorus of about 0.02 wt% or less, sulfur of about 0.03 wt% or less, chromium of about 2.2 to 3.0 wt%, molybdenum of about 0.2to 0.7 wt%, copper of about 0.3 wt% or less, niobium of about 0.03 to 0.06 wt%, vanadium of about 0.1 to 0.3 wt%, titanium of about 0.001 to 0.0030 wt%, a balance of iron and other inevitable impurities.

2. The method for producing a gear of claim 1, wherein, in the first carbon solid-dissolving step, the gear shape is dissolved at the condition of temperature of about 920 to 960° C. and carbon potential (CP) of about 1.0 to 1.3.

3. The method for producing a gear of claim 1, wherein, in the first cooling step, the gear shape is cooled for about 5 to 15 min to temperature of about 820 to 850° C. .

4. The method for producing a gear of claim 1, wherein the first quenching step is conducted at temperature of about 100 to 150° C. in oil.

5. The method for producing a gear of claim 1, wherein, in the second solid-dissolving step, the gear shape is heated at the condition of temperature of about 840 to 880° C. and CP of about 1.0 to 1.3 for dissolving carbon.

6. The method for producing a gear of claim 1, wherein, in the second cooling step, the gear shape is cooled for about 5 to 15 min to temperature of about 800 to 840° C.

7. The method for producing a gear of claim 1, wherein the second quenching step is conducted at temperature of about 100 to 150° C. in oil.

* * * * *